US006508183B2

(12) United States Patent
Kerrigan

(10) Patent No.: US 6,508,183 B2
(45) Date of Patent: Jan. 21, 2003

(54) MULTIPURPOSE TABLECLOTH

(76) Inventor: Nancy C. Kerrigan, 43 Eaton Ave., Woburn, MA (US) 01801

( * ) Notice: Subject to any disclaimer, the term of this patent is extended or adjusted under 35 U.S.C. 154(b) by 0 days.

(21) Appl. No.: 09/864,411

(22) Filed: May 25, 2001

(65) Prior Publication Data

US 2002/0174809 A1 Nov. 28, 2002

(51) Int. Cl.[7] ..... A47B 13/08
(52) U.S. Cl. ..... 108/90
(58) Field of Search ..... 108/90, 26, 25, 108/27; 150/158

(56) References Cited

U.S. PATENT DOCUMENTS

| | | | | |
|---|---|---|---|---|
| 2,586,153 | A | * | 2/1952 | Eisman |
| 3,557,856 | A | * | 1/1971 | Berman |
| 3,931,668 | A | | 1/1976 | Hombach |
| 3,960,193 | A | * | 6/1976 | Davis |
| 4,328,271 | A | | 5/1982 | Rountree |
| 4,534,474 | A | | 8/1985 | Ng |
| 4,750,402 | A | * | 6/1988 | Markey |
| 4,991,242 | A | * | 2/1991 | Brown |
| 5,299,336 | A | * | 4/1994 | Marteeny |
| D353,745 | S | | 12/1994 | Rinard |
| 5,396,993 | A | | 3/1995 | Spitler |
| 5,506,019 | A | * | 4/1996 | Abeyta et al. |
| 5,765,487 | A | * | 6/1998 | Neff |
| 6,044,774 | A | * | 4/2000 | Gelbart |
| 6,063,457 | A | | 5/2000 | Anderson |

FOREIGN PATENT DOCUMENTS

| | | | |
|---|---|---|---|
| JP | 10-213325 | * | 11/1998 |

* cited by examiner

*Primary Examiner*—Jose V. Chen
(74) *Attorney, Agent, or Firm*—Lambert & Associates; Gary E. Lambert; Edward Timmer

(57) ABSTRACT

A novel tablecloth which has pockets on its sides that allow for storage of utensils, napkins, plates, and the like, as well as writing implements, files, letters, and other useful items. The opening into the pockets could be converted from an open to a closed configuration and vise versa. Preferred embodiments of the invention allow for temporary conversion of the pockets into flaps or sleeves thus preventing accumulation of dirt and garbage inside of the pockets and allowing for easy cleaning of the tablecloth.

10 Claims, 12 Drawing Sheets

MULTIPURPOSE TABLECLOTH

FIELD OF THE INVENTION

This invention relates to a tablecloth that allows a user to store a variety of items in the pockets located on the skirt portion of the tablecloth.

Tablecloths have been in use for centuries. They provide an attractive cover for a table or a desk and also protect surface from spills and dirt. However, for the most part, a table is a functional piece of furniture since it is used for such purposes as serving food, studying, and conducting business. Therefore, there exists a problem with a regular table cloth due to the fact that it cannot store any of the items which are utilized during the use of a table. For example, a tablecloth used on a dining table has no place for storage of utensils, napkins, plates, and the like. Similarly, a tablecloth on a study or business desk is incapable of storing, in an easily accessible place, writing implements, files, letters, and other useful items.

In the past there was an attempt to invent a tablecloth that would be able to store items in pockets located on the tablecloth (Anderson, U.S. Pat. No. 6,063,457). However, that invention came short of the desired goal. A tablecloth with pockets will inevitably accumulate dirt and garbage in its pockets. In addition, a functional tablecloth must be easy to clean. The tablecloth of the prior art will accumulate crumbs, bits of food, and other dirt in its pockets since the pockets are always open and positioned in a way that would facilitate dirt accumulation. During cleaning it will be hard to clean the tablecloth with a simple swipe of a cleaning implement such as cloth. The outer surface will be cleaned but the pockets will retain and even accumulate dirt. It will most likely require removal of the tablecloth from the table to properly clean out the pockets.

What is needed is a simple, easy to use tablecloth device that would allow easy access to necessary implements such as utensils or envelopes while retaining the original utility and advantage of the everyday tablecloth—the ability to be easily cleaned. Moreover, a tablecloth should not accumulate dirt in its pockets during normal operation.

SUMMARY OF THE INVENTION

This invention satisfies the above needs. A novel multipurpose tablecloth is provided.

The claimed tablecloth has a top portion for covering a table and a skirt portion which extends beyond the top surface of a table and hangs around the sides of the table. The skirt portion houses pocket elements for storage of various useful items such as utensils or envelopes. The pocket elements could be made out a transparent material, thus allowing for an easy way to see what is stored inside of each pocket element. The opening to the pocket elements could remain open or could be closed by use of such engagement means, among others, as zippers, VELCRO, and/or tongue and groove interaction as in a ZIP-LOCK. The engagement means could be arranged in such a manner as to allow opening of the pocket elements into new configurations of flops or sleeves, thereby allowing easy cleaning of the tablecloth without accumulation of dirt inside of the pocket elements.

BRIEF DESCRIPTION OF DRAWINGS

These and other features, aspects and advantages of the present invention will become better understood with reference to the following description, appended claims, and accompanying drawings where

DESCRIPTION OF THE INVENTION

This invention represents a multipurpose tablecloth.

Figure 11:
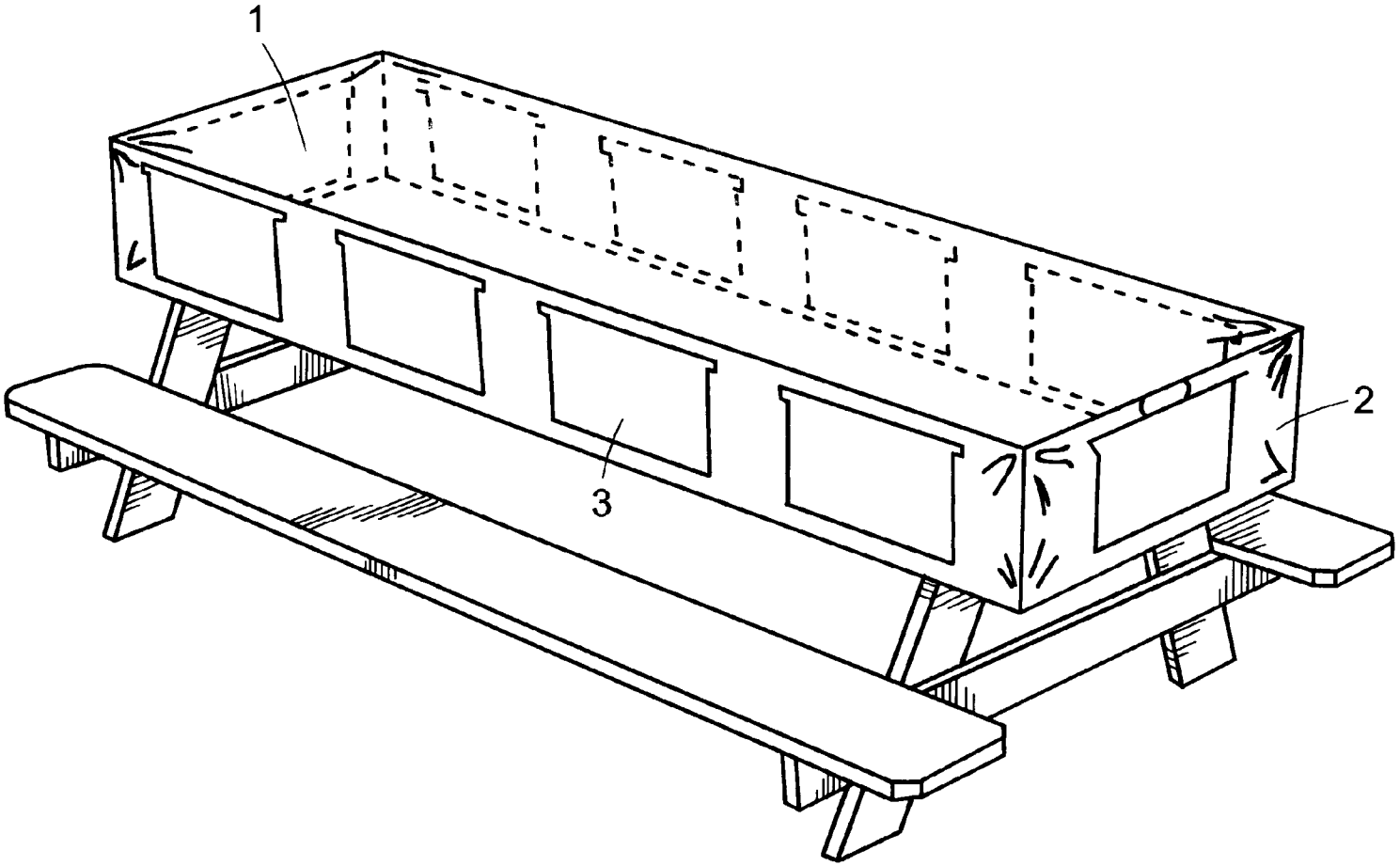
FIG. 11 is a depiction of one of the embodiments of the multipurpose tablecloth positioned on a table and ready for use.
Figure 12:
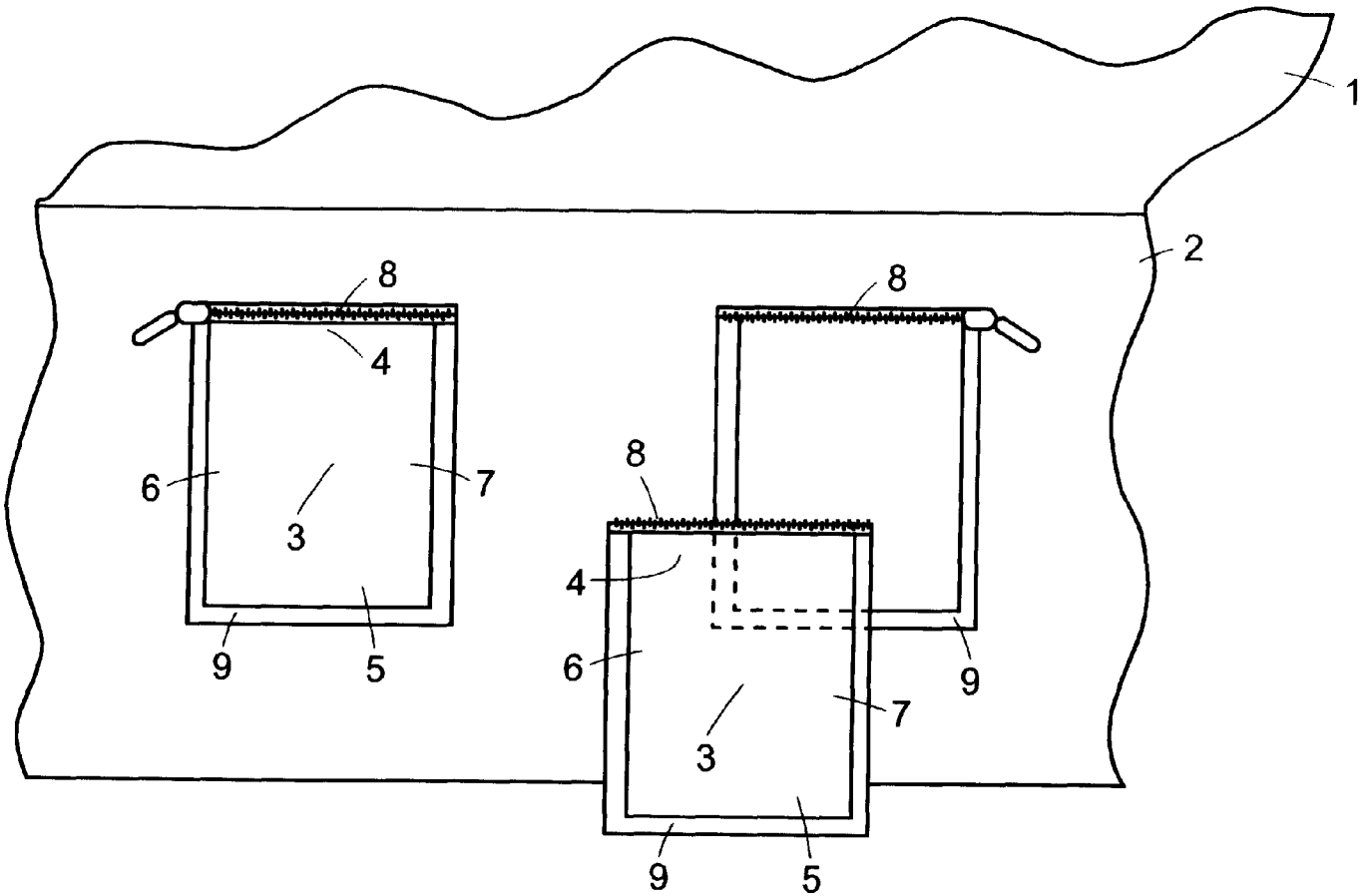
FIG. 12 is a depiction of one of the embodiments of the multipurpose tablecloth with primary and secondary engagement means wherein full disengagement of all engagement means allows for removal of the pocket element.
Figure 13:
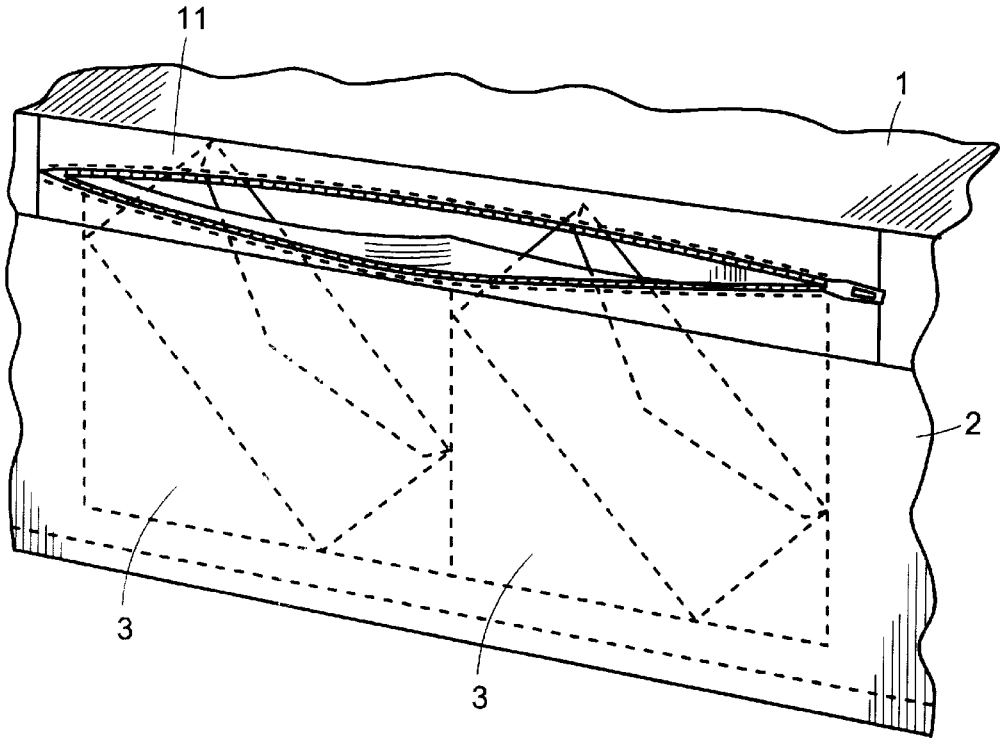
FIG. 13 is a depiction of one of the embodiments of the multipurpose tablecloth with envelopes stored inside of the pocket elements.

The basic components on the claimed tablecloth are a top portion 1 which covers the top surface of a table upon which the tablecloth is placed, a skirt portion 2 which extends beyond the edges of the table surface and hangs around the sides of the table, and a pocket element 3 located on the skirt portion 2 as shown in FIG. 11. The pocket element 3 is made out of a rectangular material superimposed on the surface of the skirt portion 2. The pocket element 3 has four ends designated as top end 4, bottom end 5, left end 6 and right end 7, as depicted in FIG. 5. An entrance to the pocket element 3 is located at the top end 4. The entrance could be open or closed through utilization of a primary engagement means 8 positioned at the top end 4 of the pocket element 3 as shown in FIG. 5. The primary engagement means 8 could be a number of different devices. For example, it could be a zipper, a VELCRO, or a tongue and groove ZIP LOCK device. These examples are not meant to be exhaustive of the possibilities for a primary engagement means 8. (The designation of the "primary" for the primary engagement means 8 is used to denote that this engagement means has a main function of controlling access to the pocket element 3.) The utility of the claimed tablecloth is in the fact that the pocket elements 3 can be used for storage of a variety of items such as utensils, napkins, business papers, envelopes, files, pens, pencils, and other items that are used at the dinner table, business desk, or a study desk as depicted in FIGS. 4, 12 and 13.

In its basic form (FIGS. 11, 5), the disclosed invention has any number of pocket elements 3 positioned on the skirt portion 2. The pocket elements' left 6, right 7, and bottom 5 ends are affixed to the skirt portion 2. The pocket elements' top end 4 can be engaged and disengaged from the skirt portion 2 by utilization of the primary engagement means 8, as depicted in FIG. 5.

Figure 9:
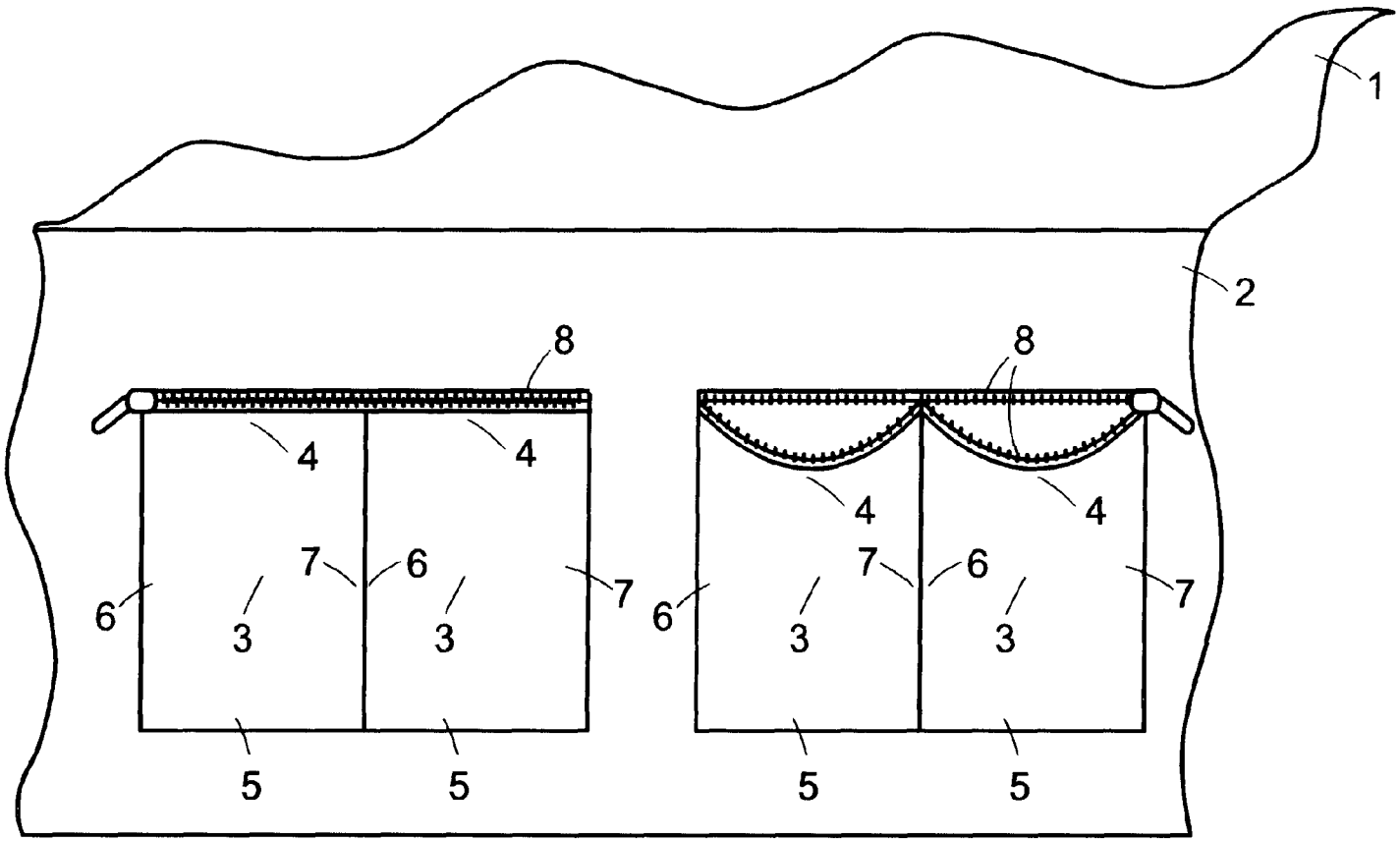
FIG. 9 is a front view of another embodiment of the invention wherein the pocket element has a primary engagement means spanning two pocket elements.

In another embodiment of the invention, the primary engagement means 8 spans across top ends 4 of more than one pocket element 3 as the pocket elements are aligned next to each other, as depicted in FIG. 9. Thus, a user can close and open more than one pocket element 3 with a single action of engaging the primary engagement means 8 as depicted in FIG. 9.

Figure 1:
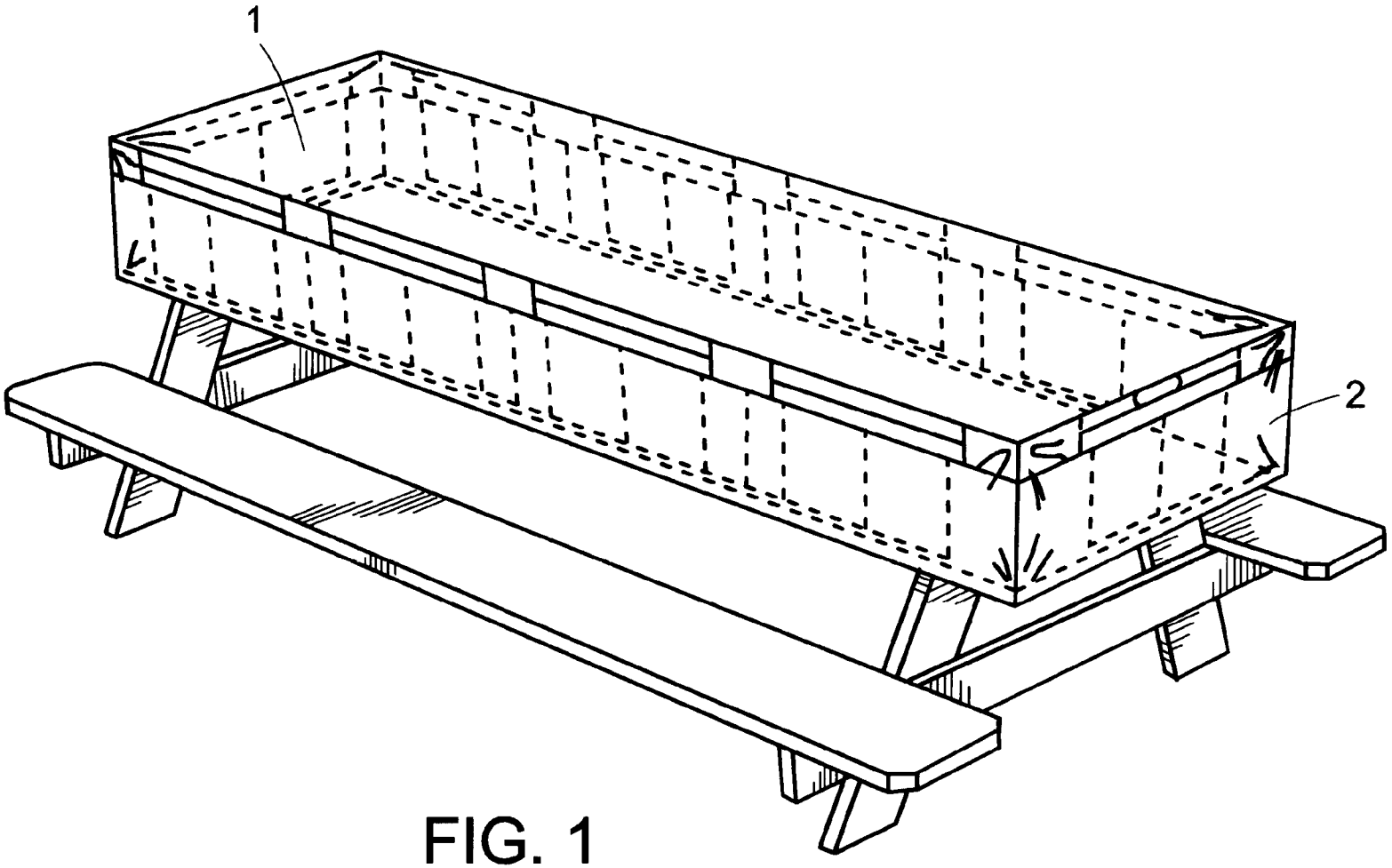
FIG. 1 is a depiction of the multipurpose tablecloth positioned on a table and ready for use.
Figure 2:
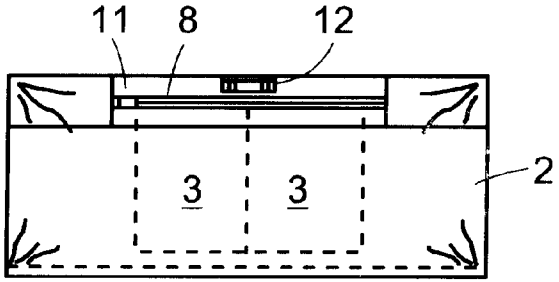
FIG. 2 is a front view of a skirt portion with pocket elements and a tag.
Figure 3:
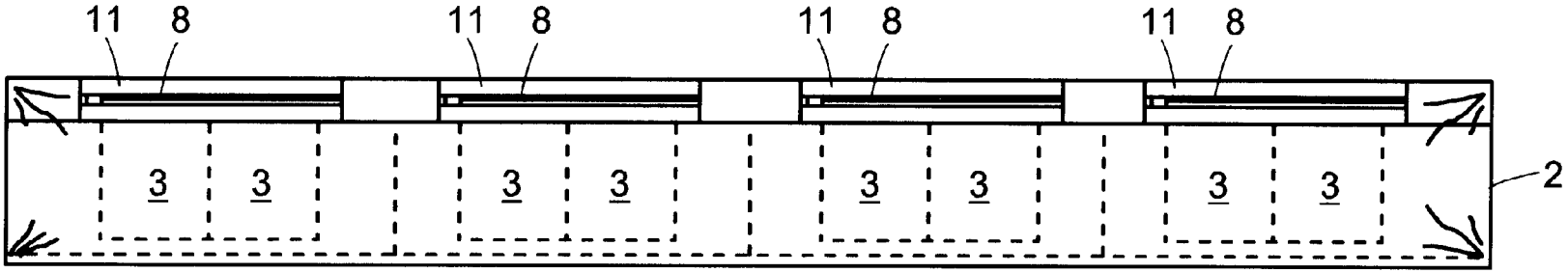
FIG. 3 is another front view of a skirt portion with pocket elements.
Figure 4:
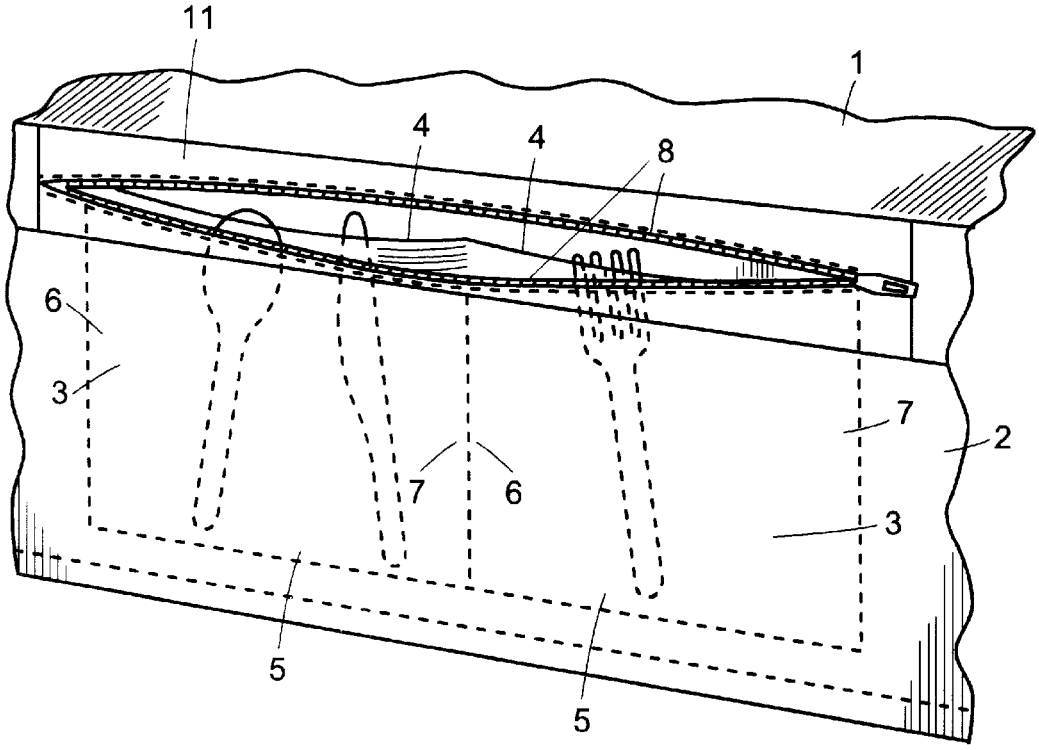
FIG. 4 is a side view of one of the embodiment of the invention showing a skirt portion with an access section, access engagement means, and two adjoined pocket elements lacking primary engagement means.
Figure 5:
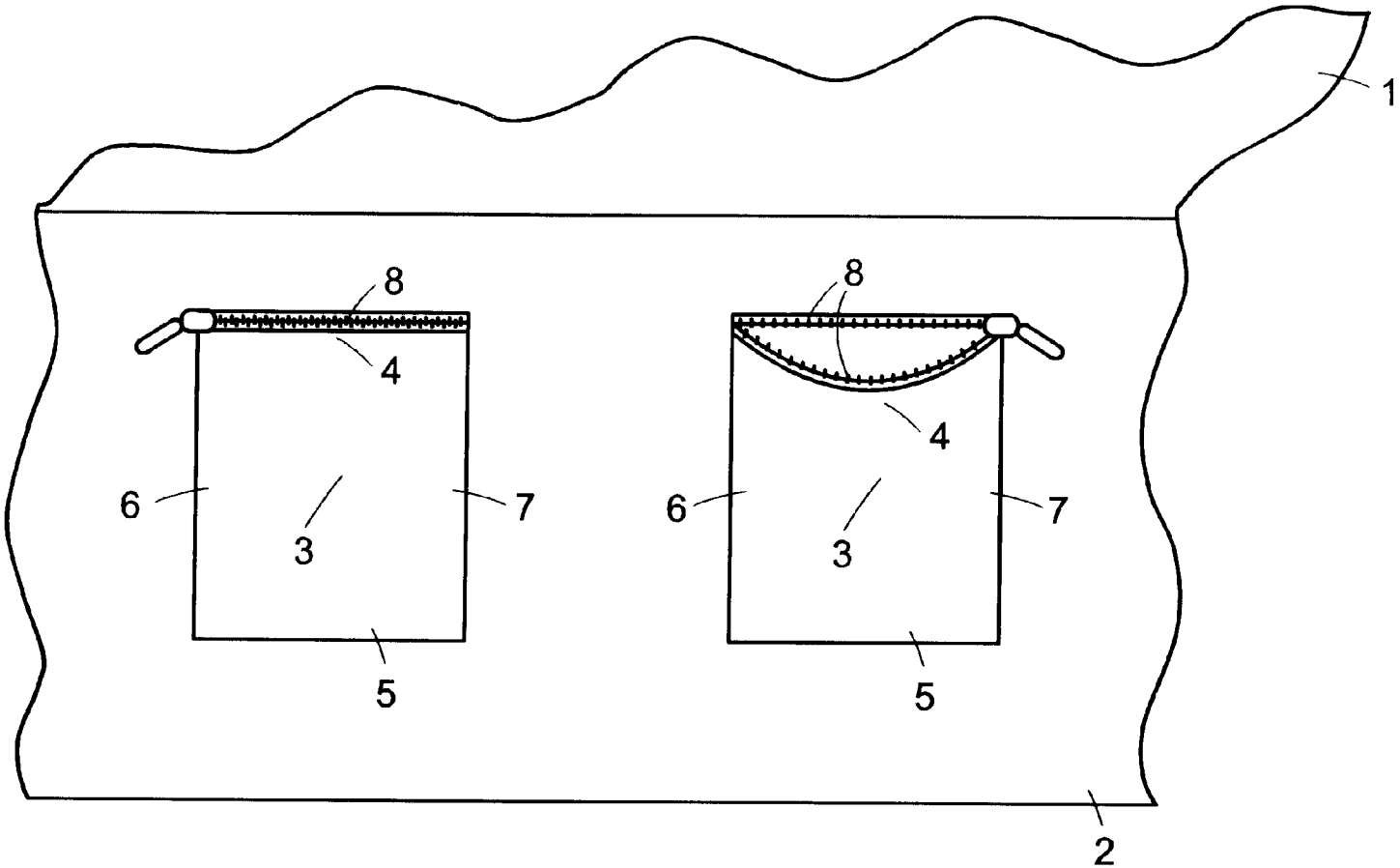
FIG. 5 is a front view of one of the embodiments of the invention wherein the pocket element has only primary engagement means.

Another embodiment of the invention is depicted in FIG. 4. An access section 11 houses a primary engagement means 8 and spans across the top end 4 of at least a single pocket element 3. The pocket element 3 has its left 6, right 7, and bottom 5 ends affixed to the skirt portion 2. The top end 4 is not affixed to the skirt portion and also lacks the primary engagement means 8—it is always in an open configuration. The entrance to the pocket element 3 in this embodiment is controlled through use of the primary engagement means 8 housed on the access section 11 as depicted in FIG. 4.

Figure 10:
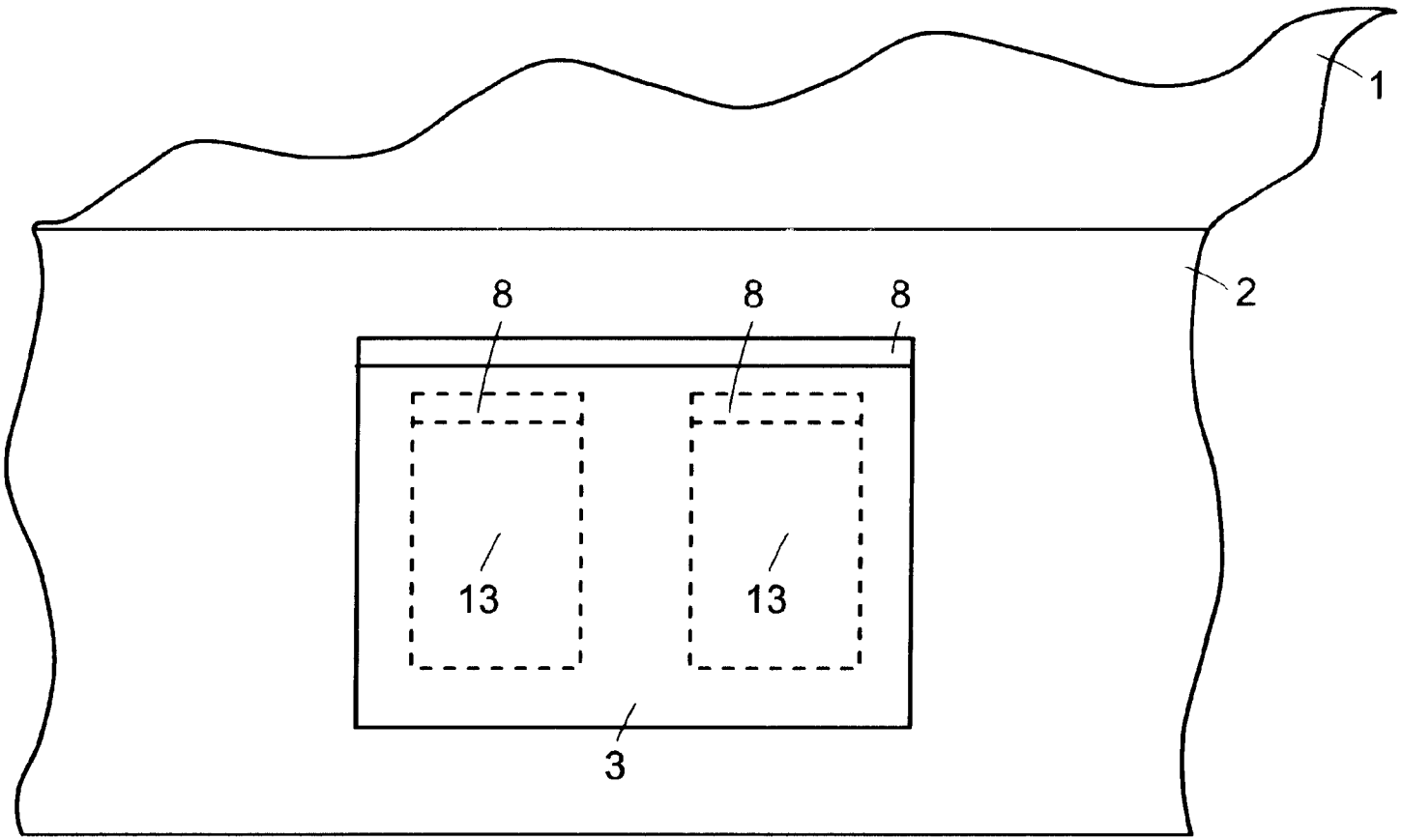
FIG. 10 is a front view of another embodiment of the invention wherein the pocket element is housing inside of it two smaller pocket elements.

Yet another embodiment of the invention is depicted in the FIG. 10. Here one pocket element 3 houses inside of it at least one smaller pocket element 13. The smaller pocket element 13 is identical in its configuration and end designations as the regular pocket element 3 except that it is smaller in size and can fit inside of the pocket element 3. In the depiction of FIG. 10, the smaller pocket element 13 has a primary engagement means 8 at its top end 4 just as does the larger encompassing pocket element 3.

DESCRIPTION OF THE PREFERRED EMBODIMENTS

Figure 6:
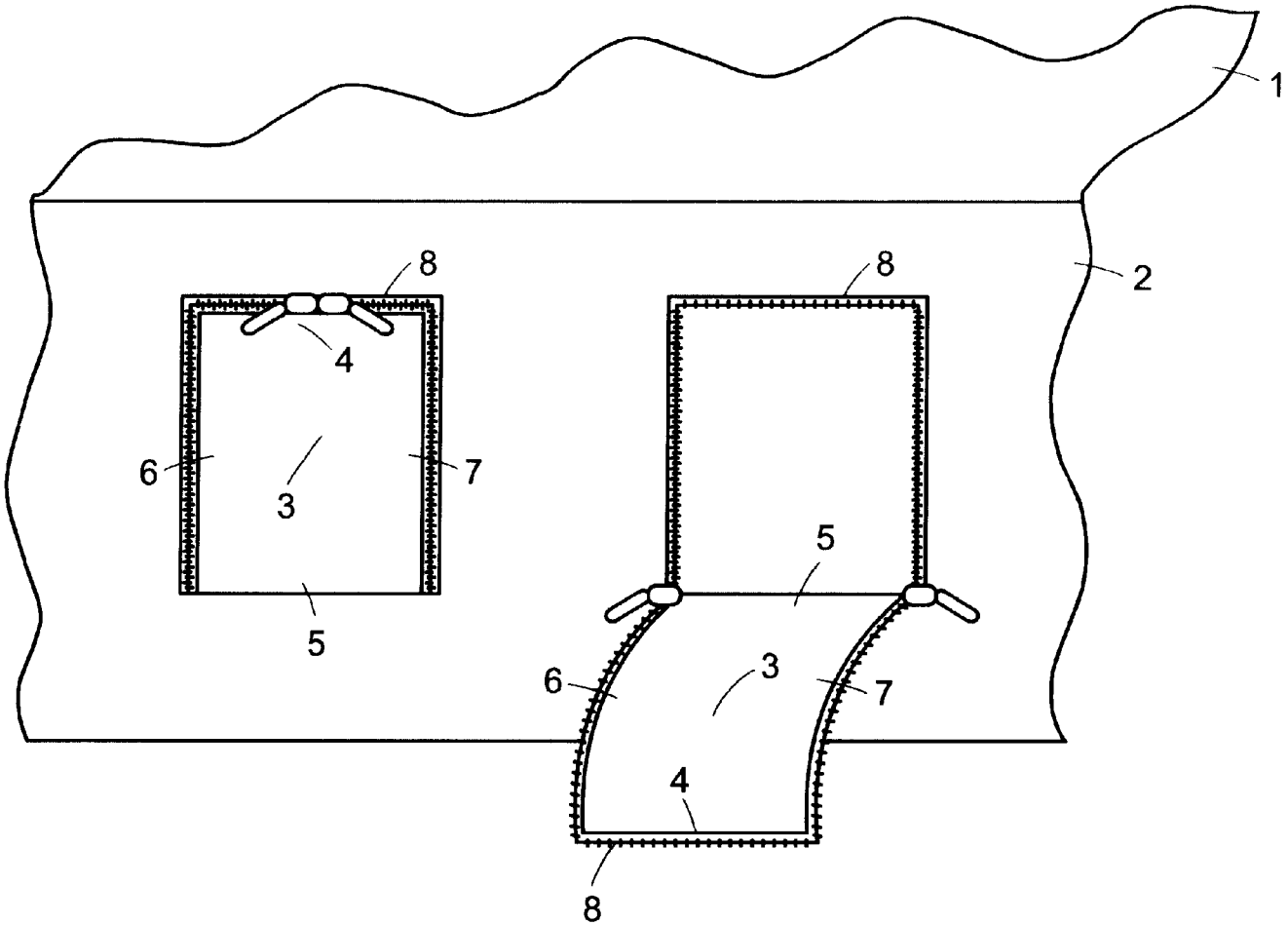
FIG. 6 is a front view of one of the embodiments of the invention wherein the pocket element has only primary engagement means and the primary engagement means spans the left, top, and right ends of the pocket element.

In one embodiment of the invention, the primary engagement means 8 is positioned at the left 6, top 4, and right 7 ends of the pocket element 3 while the bottom end 5 is affixed to the skirt portion 2 as depicted in FIG. 6. The advantage of this embodiment is that upon full disengagement of the primary engagement means 8, the pocket element 3 converts into a flap while staying affixed to the skirt portion 2 by its bottom end 5 as depicted in FIG. 6. Such configuration is useful at the times when the tablecloth is being cleaned since the pocket element will not accumulate any dirt in it. Meanwhile, during normal use of the claimed tablecloth, the pocket elements 3 could be used to store a variety of object that are handy to have by the desk. The entrance to the pocket element is closed and opened by engaging and partially disengaging the primary engagement means 8 along the length of the top end 4 of the pocket element 3.

Figure 7:
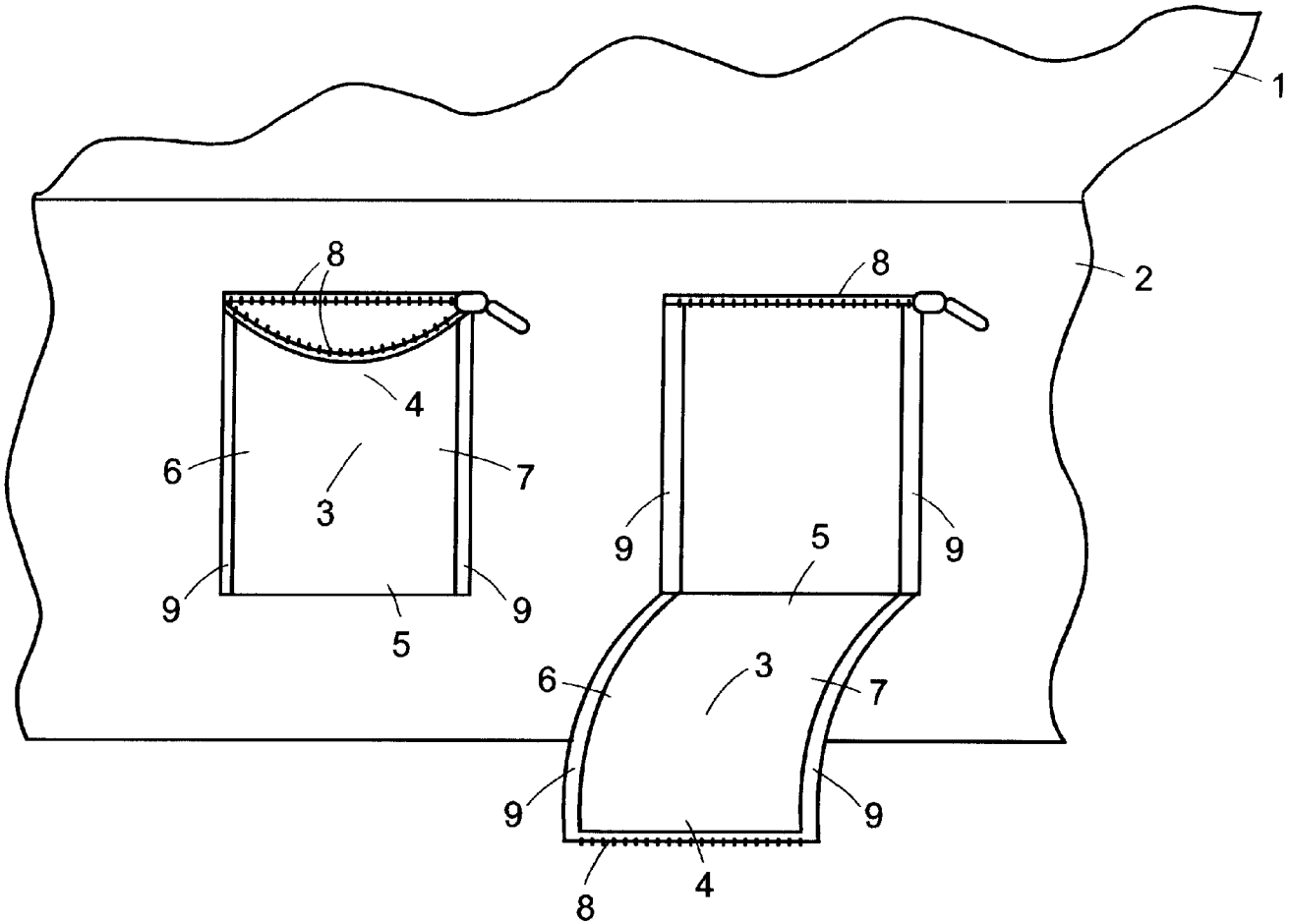
FIG. 7 is a front view of one of the embodiments of the invention showing the primary and secondary engagement means.

In a preferred embodiment, a secondary engagement means 9 is positioned at the left 6 and right 7 pocket element ends while the bottom end 5 of the pocket element 3 is affixed to the skirt portion as depicted in FIG. 7. The secondary engagement means 9 could be a number of different devices, for example it could be a zipper, a VELCRO, or a tongue and groove ZIP LOCK device. These examples are not meant to be exhaustive of the possibilities for a secondary engagement means 9. (The designation of "secondary" for the secondary engagement means 9 is used to designate that the main function of this engagement means is to keep the pocket element 3 engaged to the skirt portion 2.) The advantage of this embodiment is that the user could fully engage and disengage the primary engagement means 8 during normal use of the tablecloth without being concerned for the degree of disengagement of the primary engagement means 8 as is the case with the embodiment depicted in FIG. 6. Then, when the tablecloth needs to be cleaned, the user would disengage the primary engagement means 8 and disengage the secondary engagement means 9. The pocket element 3 turns into a flap affixed to the skirt portion 2 at its bottom end 5 as depicted in FIG. 7. As explained above, the flap configuration allows for a more thorough cleaning of the tablecloth since the pocket element 3 will not accumulate any dirt in it. Additionally, the pocket element 3 could be made out of a transparent material thus allowing for an easy way to know what is stored inside each of the pocket elements 3.

In another embodiment of the invention, the pocket element 3 has primary engagement means 8 positioned at the top end 4, and has the secondary engagement means 9 positioned at the left 6, right 7, and bottom 5 ends as depicted in FIG. 12. Here, the entire pocket element 3 could be removed from the skirt portion 2 upon disengagement of the primary 8 and secondary 9 engagement means as depicted in FIG. 12. The benefit of having the ability to remove the pocket element 3 from the skirt portion 2 lies in the fact that pocket elements 3 could be added and removed as the need dictates. By removing the pocket element 3, the user can also clean the tablecloth without worrying about trapping dirt and garbage in the pocket element 3. Alternatively, this embodiment allows for a flap configuration wherein the primary 8 and secondary 9 engagement means are disengaged with an exception of the secondary engagement means 9 being still engaged at either left 6, right 7, or bottom end 5 of the pocket element 3.

Figure 8:
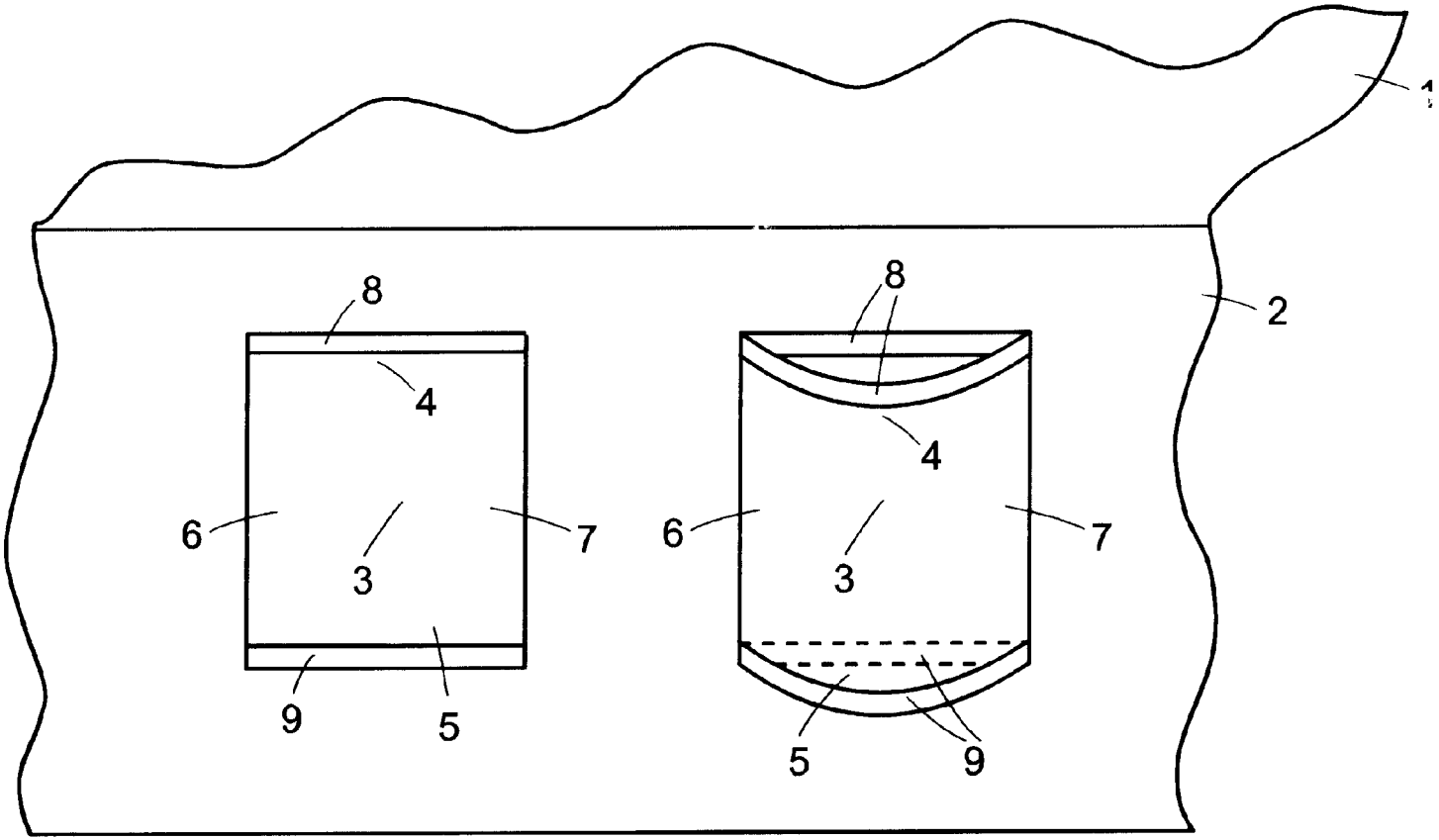
FIG. 8 is a front view of another embodiment of the invention showing the primary and secondary engagement means.

Yet another embodiment of the invention is depicted in FIG. 8. Here the primary engagement means 8 is positioned at the top end 4 of the pocket element 3, the secondary engagement means 9 is positioned at the bottom end 5, while the left 6, and right 7 ends of the pocket element 3 are affixed to the skirt portion 2. The advantage of this embodiment is that upon disengagement of primary 8 and secondary 9 engagement means the tablecloth could be cleaned without the possibility of dirt and garbage accumulating inside of the pocket element 3 since the pocket element 3 acts as a sleeve that is unable to contain any object inside of the pocket element 3, as depicted in FIG. 8.

What I claim is:

1. Multipurpose tablecloth, comprising of:

a top portion for covering a table;

a skirt portion extending beyond the edges of a table;

at least one pocket element having a plurality of ends and wherein one of each of said ends is designated as a top end, a bottom end, a left end, and a right end, and wherein at least a single pocket element is capable of housing at least one other smaller pocket element;

a primary engagement means positioned at the top end of the pocket element, wherein the primary engagement means has means for engaging the top end of the pocket element with the skirt portion, and wherein a single primary engagement means spans at least two pocket element top ends and having means for engaging said multiple pocket element top ends with the skirt portion.

2. Multipurpose tablecloth of claim 1, wherein:

the pocket element is made out of a non-flexible material.

3. Multipurpose tablecloth of claim 1, wherein:

the pocket element is made out of a transparent material.

4. Multipurpose tablecloth of claim 1, wherein:

the primary engagement means is located at the top, left, and right ends of the pocket element and said primary engagement means is capable of engaging the aforementioned pocket element ends with the skirt portion and wherein the bottom end of the pocket element is affixed to the skirt portion.

5. Multipurpose tablecloth of claim 1, further comprising:

an access section spanning across the top end of at least one pocket element, wherein the access section houses a primary engagement means and wherein the top end of the pocket element is devoid of any means to engage with the skirt portion.

6. Multipurpose tablecloth, comprising of:

a top portion for covering a table;

a skirt portion extending beyond the edges of a table;

at least one pocket element having a plurality of ends and wherein one of each of said ends is designated as a top end, a bottom end, a left end, and a right end, and wherein at least a single pocket element is capable of housing at least one other smaller pocket element;

a primary engagement means positioned at the top end of the pocket element, wherein the primary engagement means has means for engaging the top end of the pocket element with the skirt portion, and wherein a single primary engagement means spans at least two pocket element top ends and having means for engaging said multiple pocket element top ends with the skirt portion.

a secondary engagement means positioned at any of the pocket element ends other than the top pocket element end and having means for engaging such pocket element ends with the skirt portion.

7. Multipurpose tablecloth of claim 6, wherein:

the pocket element is made out of a non-flexible material.

8. Multipurpose tablecloth of claim 6, wherein:

the pocket element is made out of a transparent material.

9. Multipurpose tablecloth of claim 6, wherein:

the secondary engagement means is positioned at the left, bottom, and right pocket element ends, wherein the pocket element is detachable from the skirt portion upon disengagement of the primary and secondary engagement means.

10. Multipurpose tablecloth of claim 6, wherein:

the left and right ends of the pocket element are affixed to the skirt portion and the secondary engagement means is positioned at the bottom end of the pocket element.

* * * * *